US010323610B2

(12) United States Patent
Church et al.

(10) Patent No.: US 10,323,610 B2
(45) Date of Patent: Jun. 18, 2019

(54) NOISE ATTENUATION DEVICE FOR AN INTAKE SYSTEM OF AN INTERNAL COMBUSTION ENGINE

(71) Applicant: Ford Global Technologies, LLC, Dearborn, MI (US)

(72) Inventors: Jeremy Walter Church, Belleville, MI (US); Larry Conklin, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 168 days.

(21) Appl. No.: 14/992,816

(22) Filed: Jan. 11, 2016

(65) Prior Publication Data

US 2017/0198667 A1 Jul. 13, 2017

(51) Int. Cl.

| | |
|---|---|
| ***F02D 9/08*** | (2006.01) |
| ***F02M 35/12*** | (2006.01) |
| ***F02D 9/02*** | (2006.01) |

(52) U.S. Cl.

CPC ..... *F02M 35/1211* (2013.01); *F02D 9/02* (2013.01)

(58) Field of Classification Search

CPC ..... F02M 35/1211; F02D 9/02
USPC ..... 123/337
See application file for complete search history.

(56) References Cited

U.S. PATENT DOCUMENTS

| | | | | |
|---|---|---|---|---|
| 4,494,625 | A | 1/1985 | Mathes | |
| 5,722,357 | A * | 3/1998 | Choi | F02M 29/04 123/184.21 |
| 5,758,614 | A * | 6/1998 | Choi | F02D 9/104 123/184.53 |
| 5,924,398 | A | 7/1999 | Choi | |
| 5,970,963 | A * | 10/1999 | Nakase | F02M 35/1211 123/184.21 |
| 6,343,583 | B1 | 2/2002 | Nishida | |
| 6,691,662 | B2 | 2/2004 | Pontoppidan | |
| 7,337,831 | B2 * | 3/2008 | Torii | F28F 1/32 165/109.1 |
| 7,815,163 | B2 | 10/2010 | Siame et al. | |
| 8,166,775 | B2 * | 5/2012 | Choi | B60H 1/00564 181/224 |
| 8,784,047 | B2 * | 7/2014 | Elder | F02K 3/115 415/116 |

FOREIGN PATENT DOCUMENTS

| | | | | |
|---|---|---|---|---|
| JP | H10-121994 | * | 5/1998 | F02D 9/10 |
| JP | 2013104390 A | * | 5/2013 | F02D 11/10 |

* cited by examiner

*Primary Examiner* — Hung Q Nguyen
*Assistant Examiner* — Anthony Donald Taylor, Jr.
(74) *Attorney, Agent, or Firm* — Julia Voutyras; McCoy Russell LLP

(57) ABSTRACT

Methods and systems are provided for a noise attenuation device. In one example, a system may include a noise attenuation device located downstream of a throttle body with a height less than or equal to a difference in radiuses between a bore of the throttle body and an intake passage.

17 Claims, 3 Drawing Sheets

NOISE ATTENUATION DEVICE FOR AN INTAKE SYSTEM OF AN INTERNAL COMBUSTION ENGINE

FIELD

The present description relates generally to reducing noise caused by turbulent air flow in an intake manifold of a passenger vehicle traveling on the road.

BACKGROUND/SUMMARY

Intake manifolds may be formed with plastics in an effort to reduce vehicle cost and weight. However, plastic components are less dense than an equivalent metal component, which may lead to certain issues. For example, during vehicle travel, a noise may be generated by an air flow pattern at various throttle valve angles, including but not limited to tip-in or fast opening. The noise may penetrate the plastic passageways and radiate to a driver of the vehicle, resulting in undesirable sounds.

One example approach to reduce this noise is shown by Choi et al. in U.S. Pat. No. 5,722,357. Therein, an air diffuser is located between a throttle body and an intake manifold with radial vanes protruding into an intake path. The air diffuser may disrupt an air flow pattern and reduce noise emanating from the intake manifold.

However, the inventors herein have recognized a disadvantage with prior art noise reduction system for intake air passages. As one example, these noise reduction systems may decrease bulk airflow due to their protrusion into the intake path for a given throttle bore size, which may ultimately decrease an engine power output. Furthermore, such intake systems may have discontinuities so that the system can be packaged into the vehicle. Air flowing around these discontinuities can produce noise due to turbulent intake air flow. This noise can be bothersome to customers. Additionally, while increasing throttle bore may be used to counteract flow restrictions, this may cause still other problems related to not only packaging, but also airflow controllability which can be particularly relevant to idle speed control, air-fuel ratio control, etc.

In one example, the issues described above may be addressed by an intake system comprising a throttle body in an intake passage with a bore having a first radius smaller than a second radius of the intake passage and a noise attenuation device with a plurality of vanes located in the intake passage directly downstream of the throttle body and where a maximum height of the vanes is substantially equal to a difference between the radius. In this way, the vanes may decrease noise while not decreasing bulk airflow.

As one example, the vanes extend inwardly into the intake passage for a predetermined height equal to or less than the difference the first and second radius. The vanes may diffuse and/or redirect air flow that may otherwise impinge onto surfaces of the intake passage and produce an undesired noise. By diffusing the intake flow, the noise may be decreased or prevented such that it may not emanate from the intake passage.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-7 are shown approximately to scale, however other embodiments may be used.

DETAILED DESCRIPTION

Figure 1:
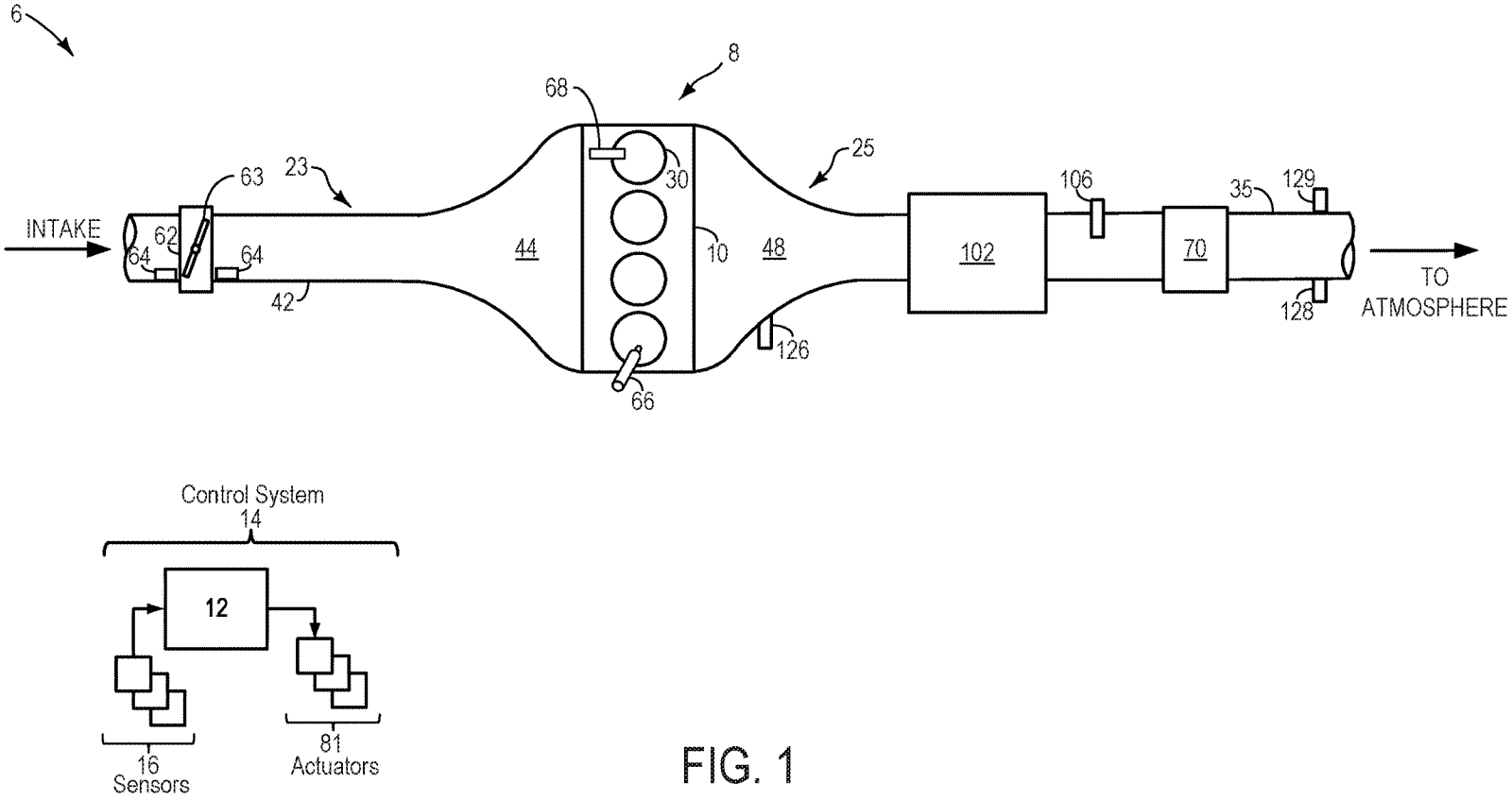
FIG. 1 shows a schematic of an example engine.
Figure 2:
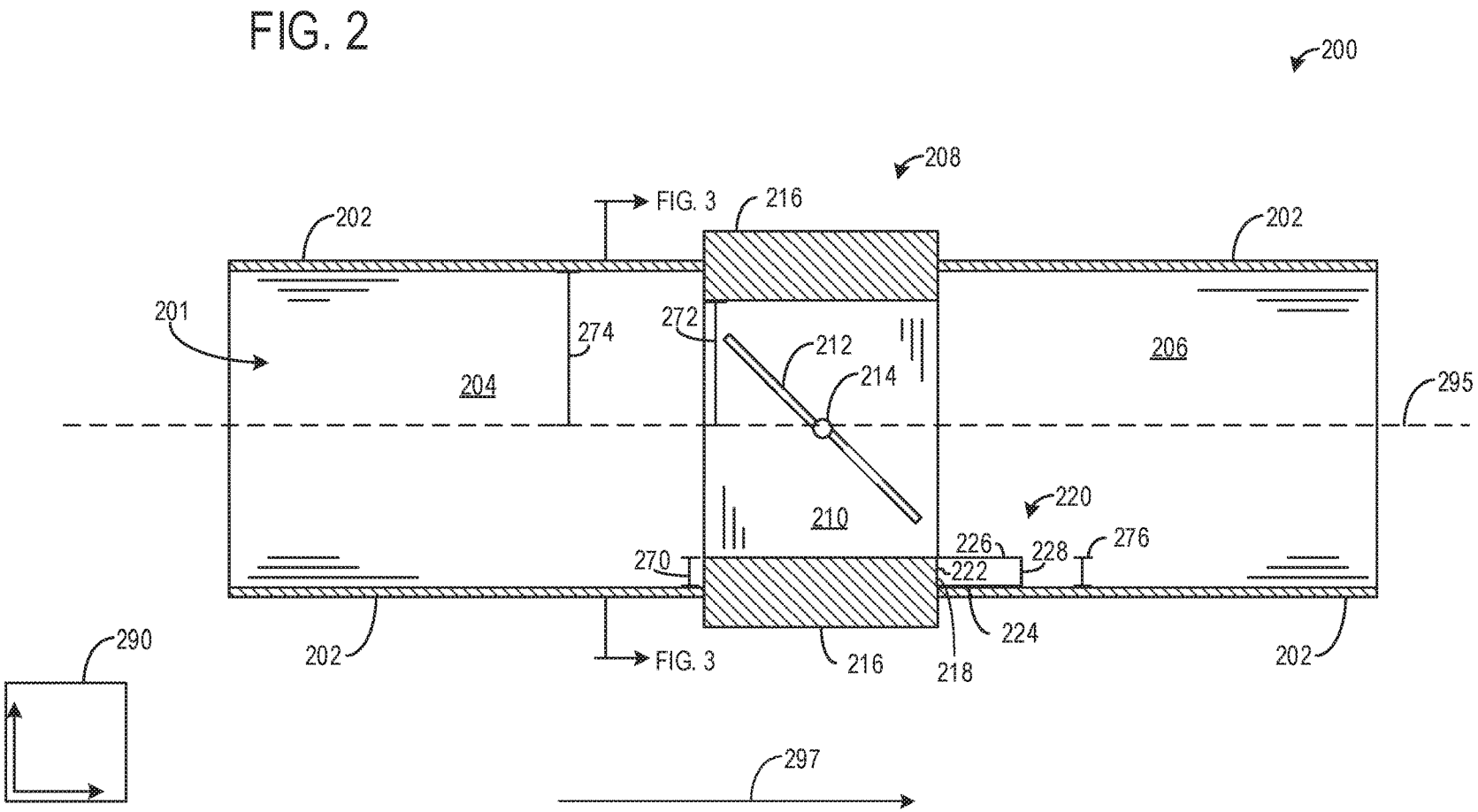
FIG. 2 shows a cross-sectional view of an intake passage with a throttle body and a noise attenuation device located therein.
Figure 3:
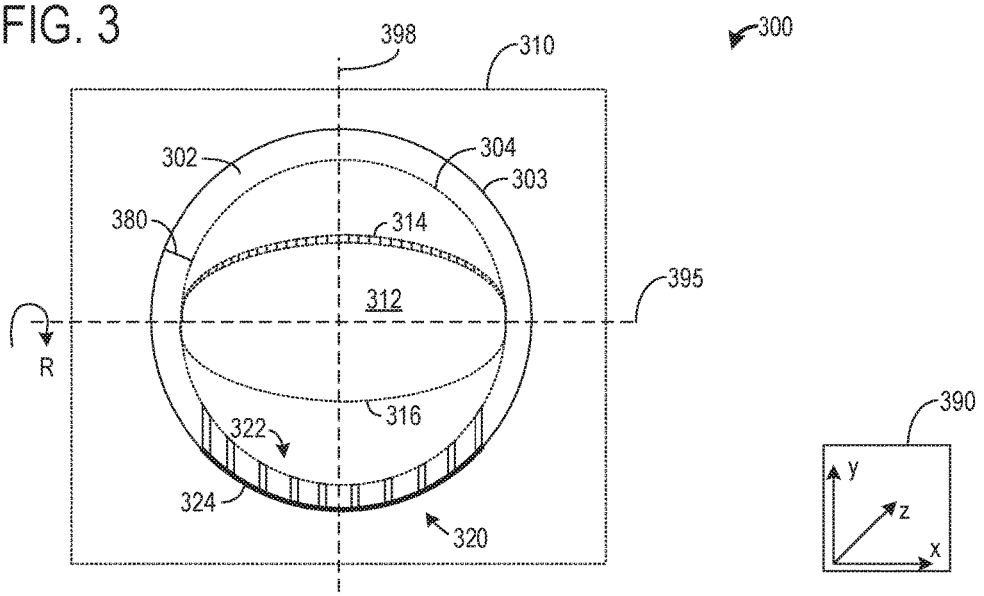
FIG. 3 shows a face-on view of the throttle body and noise attenuation device.

The following description relates to systems for a noise attenuation device directly downstream a throttle body of an intake passage. An engine utilizing the intake passage is shown in FIG. 1. The noise attenuation device is welded to the throttle body via an upstream face and welded to the intake passage via a base. A height of the noise attenuation device is substantially equal to a difference between a radius of the throttle body and a radius of the intake passage, as shown in FIG. 2. An upstream-to-downstream view of the noise attenuation device located directly downstream of a transparent throttle body is shown in FIG. 3. FIGS. 4, 5, 6, and 7 show various embodiments of the noise attenuation device.

FIGS. 2-7 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example.

FIG. 1 shows a schematic depiction of a vehicle system 6. The vehicle system 6 includes an engine system 8. The engine system 8 may include an engine 10 having a plurality of cylinders 30. Engine 10 includes an engine intake system 23 and an engine exhaust 25. Engine intake system 23 includes a throttle 62 fluidly coupled to the engine intake manifold 44 via an intake passage 42. The throttle 62 includes a first bore concentric with a second bore of the intake passage 42. In one example, the first bore has a first radius smaller than a second radius of the second bore. The engine exhaust 25 includes an exhaust manifold 48 eventually leading to an exhaust passage 35 that routes exhaust gas to the atmosphere. Throttle 62 may be located in intake passage 42 downstream of a boosting device, such as a turbocharger (not shown), and upstream of an after-cooler (not shown). When included, the after-cooler may be configured to reduce the temperature of intake air compressed by the boosting device.

A noise attenuation device 64 may be located downstream of the throttle 62 along a bottom portion of the intake passage 42. As shown, the noise attenuation device 64 is coupled to a lowest portion of the intake passage 42. The throttle 62 comprises a throttle valve 63 which may rotate based on an engine load to restrict intake flow. The throttle valve 63 may direct intake flow such that turbulent intake flow may impinge on lower interior surfaces of the intake passage 42 generating audible sounds. The noise attenuation device 64 may comprise a plurality of vanes extending inwardly for diffusing and redirecting the intake flow. The vanes protrude only partially into the intake passage 42 and do not span across the intake passage as will be described below.

Engine exhaust 25 may include one or more emission control devices 70, which may be mounted in a close-coupled position in the exhaust. One or more emission control devices may include a three-way catalyst, lean NOx filter, SCR catalyst, etc. Engine exhaust 25 may also include a PF 102, which temporarily filters PMs from entering gases, positioned upstream of emission control device 70. In one example, as depicted, PF 102 is a gasoline particulate matter retaining system. PF 102 may have a monolith structure made of, for example, cordierite or silicon carbide, with a plurality of channels inside for filtering particulate matter from diesel exhaust gas. Tailpipe exhaust gas that has been filtered of PMs, following passage through PF 102, may be measured in a PM sensor 106 and further processed in emission control device 70 and expelled to the atmosphere via exhaust passage 35.

The vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust flow rate sensor 126 configured to measure a flow rate of exhaust gas through the exhaust passage 35, exhaust gas sensor (located in exhaust manifold 48), temperature sensor 128, pressure sensor 129 (located downstream of emission control device 70), and PM sensor 106. Other sensors such as additional pressure, temperature, air/fuel ratio, exhaust flow rate and composition sensors may be coupled to various locations in the vehicle system 6. As another example, the actuators may include fuel injectors 66, throttle 62, spark plugs 68, aftertreatment valves that control filter regeneration (not shown), a motor actuator controlling PM sensor opening (e.g., controller opening of a valve or plate in an inlet of the PM sensor), etc. Thus, engine 10 may be a spark ignited (gasoline engine). In some embodiments, spark plugs 68 may be omitted and engine 10 may be a diesel engine. The control system 14 may include a controller 12. The controller 12 may be configured with computer readable instructions stored on non-transitory memory. The controller 12 receives signals from the various sensors of FIG. 1, processes the signals, and employs the various actuators of FIG. 1 to adjust engine operation based on the received signals and instructions stored on a memory of the controller.

Thus, the vehicle system may be used in a passenger vehicle. A method of operating an intake system in a passenger vehicle traveling on the road may comprise directing an intake flow to an engine of the vehicle via an intake passage, where the passage includes a throttle body with a bore generating upstream and downstream discontinuities and where a set of vanes is located adjacent to one of the discontinuities. The throttle valve is operated to adjust a volume of intake flow in the intake passage. The vanes protrude into the intake passage for a predetermined distance equal to a height of one of the discontinuities. Therefore, the vanes protrude only partially into the intake passage and do not span across the intake passage. The discontinuities arise from a difference between a first radius of the bore of the throttle body and a second diameter of the intake passage, where the first radius is smaller than the second radius. Thus, the predetermined distance is substantially equal to the difference, which is substantially equal to the height of one of the discontinuities. The vanes (noise attenuation device) may be pressed against or spaced away from one or more of the upstream and downstream discontinuities. In one example, the noise attenuation device is located only behind the downstream discontinuity.

FIG. 2 shows a cross-sectional view of an intake system 200 with a noise attenuation device 220 located directly downstream of a throttle body 208. The noise attenuation device 220 (noise attenuation device 64 in the embodiment of FIG. 1) is configured to diffuse and redirect air flowing from the throttle body 208 (throttle 62 in the embodiment of FIG. 1) toward an engine (engine 10 in the embodiment FIG. 1) to decrease noises emanating from an intake system of a moving vehicle during some engine operating conditions. It will be appreciated that intake system 200 is shown in simplified form by way of example and that other configurations are possible.

An axes system 290 comprises two axes, namely a horizontal axis and a vertical (axial) axis. A central axis 295 of an intake pipe 202 is parallel to the horizontal axis. Arrow 297 depicts a general direction of intake gas parallel to the horizontal axis inside the intake pipe 202. The intake pipe 202 defines an outer boundary of an intake passage 201 and therefore includes a bore located therein.

The throttle body 208 divides an intake passage 201 (e.g., intake passage 42 in the embodiment of FIG. 1) within the intake pipe 202 into two separate segments, an upstream intake passage 204 and a downstream intake passage 206. The upstream 204 and downstream 206 intake passages sandwich the throttle body 208 and may be substantially fluidly separated when a valve 212 of the throttle body 208 is in a closed position. Therefore, the upstream 204 and downstream 206 intake passage are fluidly coupled for a valve 212 outside of the closed position (at least partially open position). For a valve 212 in an at least partially open position, intake air initially flows through the upstream intake passage 204, through a bore 210 of the throttle body 208, and into the downstream passage 206. In this way, the intake passage 201 (upstream intake passage 204, bore 210, and downstream intake passage 206) is a contiguous pathway. An amount of air flowing from the upstream intake passage 204 to the downstream intake passage 206 may be adjusted by the throttle valve 212. A more open position of the throttle valve 212 allows a greater mass of air to flow into the downstream intake passage 206 than a more closed position of the throttle valve 212. Thus, the throttle valve 212 may rotate via a rotating device 214 with a range of motion of 90°, 180°, or 360°. In this way, the throttle valve may be perpendicular to the central axis 295 (fully closed) or parallel to the central axis (fully open). The fully closed position may allow at least a minimum amount of air into the downstream intake passage 206 and the fully open position may allow a maximum amount of air into the downstream intake passage. In this way, the throttle valve 212 in the closed position may be minimally spaced away from the throttle body 208.

The throttle body 208 comprises an annular, contiguous first bore wall 216. Wall 216 defines the bore 210, with edges of the wall 216 blocking outer portions of the intake passage 201. Thus, wall 216 has a first (inner) radius 272 smaller than a second radius 274 of the bore of intake pipe 202. Thus, the intake pipe 202 may serve as a second bore wall defining the bore of the intake passage 201. The wall 216 may be thicker than and misaligned with the intake pipe 202, such that a difference 270 between the radiuses extends around an entire inner circumference of the intake pipe 202. In this way, the wall 216 is sized such that a portion of the wall 216 extends into the intake passage 201, narrowing an area for intake flow to flow through at the throttle body 208. Thus, the wall 216 generates discontinuities in the intake passage 201 due to a change in radius as described above.

Intake flow (e.g., motive flow, EGR, ram air, etc.) may collide with lower interior surfaces of the downstream intake passage 206 adjacent the throttle body 208 (below the central axis 295). Uninterrupted (turbulent) flow of intake air in this way may produce undesirable audible noises. Specifically, noise may be generated near an interface between the throttle body 208 and the downstream intake passage 206 during some engine conditions based on a position of the throttle valve 212. The noise attenuation device 220 may decrease and/or prevent a generation of the audible sound by altering the intake air flow. The noise attenuation device comprises features (vanes) for diffusing the intake air flow through a range of valve positions, as will be described below. The noise attenuation device 220 is shown only on the bottom portion of the downstream intake passage 206, but may be located around an entire inner circumference of the downstream intake passage adjacent to the throttle body 208. As shown, a height 276 of the noise attenuation device is substantially equal to the difference 270 between first 272 and second 274 radius of the bore 210 and the intake pipe 202, respectively. Substantially equal may be defined as the height and the difference deviating from each other due to production induced tolerances by 2-5% in one example. In one example, the height 276 may be a maximum height of the noise attenuation device 220. Thus, the noise attenuation device 220 does not extend into an air space of the intake passage 201 directly downstream of the bore 210. In some embodiments, the height 276 may be shorter than the discontinuity 270. In this way, the noise attenuation device does not inhibit intake air flow while providing greater noise attenuation capabilities compared to the prior art, which extends beyond the difference 270.

The noise attenuation device 220 is shown coupled to the wall 216 and the lower portion of the downstream intake passage 206 adjacent the wall 216. Specifically, an upstream face 222 is in face-sharing contact with a downstream side 218 of the wall 216 of the throttle body 208 and a base 224 is coupled to the intake pipe 202. The noise attenuation device may be coupled to the wall 216 and the downstream intake passage 206 via welds, adhesives, etc., as will be described below. Alternatively, in one example, a lower portion of the wall 216 may be manufactured with grooves, notches, and/or other locking features corresponding to locking features manufactured onto the upstream face 222 of the noise attenuation device 220. In this way, the noise attenuation device 220 may be more accessible and easier to replace than a molded noise attenuation device. In another example, the intake conduit 202 and the noise attenuation device 220 may be manufactured as a single, contiguous piece. The upstream face 222 and downstream face 228 are normal to a direction of intake flow (arrow 297) and the base 224 and a top face 226 of the noise attenuation device 220 are parallel to a direction of intake flow. The noise attenuation device comprises a rectangular cross-section. It will be appreciated that the noise attenuation device may comprise other suitably shaped cross-sections, for example, triangular, without departing from the scope of the present disclosure. In some examples, the upstream face 222 may be spaced away from the throttle body 208 with only the base 224 anchoring the noise attenuation device 220 in the intake passage 201. Additionally or alternatively, there may be a second noise attenuation device located upstream of the throttle body 208 at an interface between the throttle body and the intake conduit 202 in a lower portion (below the central axis 295) of the upstream intake passage 204. Features of the noise attenuation device 220 will be described in greater detail with respect to FIGS. 3-7. It will be appreciated by someone skilled in the art that the noise attenuation device may be used in other flowing systems using similar valves and/or assembled joints as those described above, for example, in an HVAC or compressed air system. For example, a gas and/or fluid flow system may include a valve body, such as a throttle body or flap valve or other valve, in a passage with a bore having a first radius smaller than a second radius of the passage, and a noise attenuation device with a plurality of vanes located in the passage directly downstream of the valve body where a maximum height of the vanes is substantially equal to a difference between the radiuses. The system may be one where the vanes have at least some protrusion as compared with immediately downstream of the vanes, and/or the vanes have an upstream surface in face sharing contact with the expansion region between the unequal radiuses, and/or one or more of the various features described herein with regard to FIGS. 1-7.

For example, an intake system may comprise a throttle body in an intake passage with a bore having a first radius smaller than a second radius meter of the intake passage. A valve is mounted within the first bore and being moveable to selectively restrict intake flow. A noise attenuation device with a plurality of vanes may be located in the intake passage directly downstream of the throttle body and where a height of the vanes is substantially equal to a difference between the radius. The plurality of vanes extend inwardly from a base of the noise attenuation device into the intake passage, where the vanes are configured to diffuse and/or redirect intake flow. The noise attenuation device (vanes) may be pressed against or spaced away from the throttle body depending on a configuration of the intake passage and/or a noise characteristic of the intake system. The vanes extend inwardly into the intake passage for a predetermined distance, where the predetermined distance is based on a circumference of the bore of the throttle body.

FIG. 3 shows an upstream-to-downstream (face-on) view 300 of a throttle body 310 and a noise attenuation device 320. The throttle body 310 is transparent (as indicated by small dash lines) to illustrate the noise attenuation device 320 in the view 300 that would otherwise be occluded by the throttle body. The throttle body 310 may be used similarly to the throttle body 208 in the embodiment of FIG. 2 or throttle 62 in the embodiment of FIG. 1. The noise attenuation device 320 may be used similarly to the noise attenuation device 220 in the embodiment of FIG. 2 and/or to the noise attenuation device 64 in the embodiment of FIG. 1.

An axes system 390 is shown comprising three axes, an x-axis parallel to the horizontal axis, a y-axis parallel to the vertical axis, and a z-axis perpendicular to the x and y axes.

A rotation axis 395 of a valve 312 of the throttle body is parallel to the x-axis and shown by a large dash line with an arrow R depicting a direction of rotation. A central axis 398 of the noise attenuation device 320 is parallel to the y-axis. The noise attenuation device 320 is symmetric about the central axis 398, however, the noise attenuation device may be asymmetric without departing from the scope of the present disclosure. Intake air flows parallel to the z-axis through an intake passage 302. Intake air may contact the throttle body 310 before contacting the noise attenuation device 320. Thus, solid lines indicate components farther along the z-direction than small dash lines. Large dash lines are bigger than small dash lines.

The valve 312 may rotate about the rotation axis 395 (x-axis) in a direction shown by arrow R with a range of motion between 90° to 360°. The valve 312 is shown rotated about the rotation axis 395 in a partially open position with a first end 314 facing an upstream direction and a second end 316 facing a downstream direction with respect to intake air flow. The second end 316 may direct a portion of intake air flow toward the noise attenuation device 320 located on a bottom portion of the intake passage adjacent a change in radiuses (discontinuity) between a first bore 303 of the intake passage 302 and a second bore 304 of the throttle body 310. In some examples, the valve 312 may rotate in a direction opposite arrow R, in which case, the noise attenuation device 320 may be located in an upper portion of the intake passage 302. The bores are concentric, wherein the first bore 303 is bigger than the second bore 304 by a distance 380 along an entire circumference of the second bore 304. The noise attenuation device 320 is directly downstream of the discontinuity created by the change in size (radius) of the bores. The device 320 is physically coupled to a portion of an inner the intake passage 302 via a base 324 (indicated by a thick line). The noise attenuation device 320 comprises a plurality of vanes 322 extending inwardly from the base 324 into the intake passage 302. The plurality of vanes 322 may be formed of the same material as the base 324, where both components can be comprised of a plastic and attached together via one or more of glue, an interference fit, or sonic weld. Alternatively, the components may be metal, wherein they may be cast as a single piece or separate pieces. In the case where the vanes 322 and the base 324 are separate pieces, they may be welded together. In some embodiments, the plurality of vanes 322 may be a first set of vanes, where a second set of vanes may be located in an upper portion of the intake passage 302, opposite the first set. Alternatively, the second set of vanes may be located upstream of the throttle body 310 adjacent an upstream discontinuity. It will be appreciated that a suitable number of sets of vanes may be located in a vehicle system in upstream and downstream positions adjacent discontinuities generated by features of the vehicle system components.

The vanes 322 are shown extending inwardly in an axial direction with none of the vanes 322 extending beyond a circumference of the second bore 304 of the throttle body 310. In this way, a height of the vanes 322 may be staggered wherein outer vanes of the vanes 322 are taller than inner vanes of the vanes 322. Alternatively, vanes 322 may extend from a predetermined axial position (a position of the base 324 along the y-axis) lower than a lowest portion of the bore 304 and extend radially inward from base 324 for a predetermined distance into intake passage 302. The predetermined distance is less than or equal to difference 380 between the radiuses of the first bore 303 and the second bore 304. The vanes 322 may be substantially identical in length and width when extending in the radial direction. The number, shape, length, height, thickness, and orientation of the vanes 322 may be varied based on desired noise dampening characteristics of the noise attenuation device 320.

The vanes 322 are shown extending inwardly along the y-axis for a portion of a circumference of a bottom portion of the intake passage 302. For example, each of the vanes 322 may extend inwardly 5-10 mm from base 324 and have a thickness of 1-2 mm. Further, vanes 322 may be spaced about an inner circumference of intake passage 302 substantially equidistant from one another. Substantially equidistant may be defined as the distances between the vanes deviating from other distances between the vanes due to production induced intolerances by 2-5% in one example. Alternatively, they may be spaced non-equidistant from one another. The vanes 322 extend the z-axis parallel to the intake flow for some distance. In some examples, the base 324 may span all of the inner circumference with vanes 322 extending radially inward.

Referring to FIGS. 4-7, several alternate embodiments of noise attenuation devices (noise attenuation device 64 of FIG. 1 noise attenuation device 220 of FIG. 2 or noise attenuation device 320 of FIG. 3) or air diffusers are shown. Each embodiment may be disposed downstream of a discontinuity between a throttle body and an intake passage to reduce noise generated therein. The noise attenuation device may be coupled to only a bottom portion of the intake passage, however, the noise attenuation device may be located adjacent other discontinuities of a gas passage without departing from the scope of the present disclosure. Each embodiment may be constructed from steel, high temperature plastic, cast aluminum, dis-cast aluminum, or ceramic, or combinations thereof. Further, the number, shape, axial length, inwardly extending distance, thickness, and orientation of the vanes may be varied based on desired flow characteristics and noise damping characteristics of devices in an intake system. Further, multiple noise attenuation devices may be used in multiple locations intake systems. For example, a noise attenuation device may be places upstream of a discontinuity.

Figure 4:
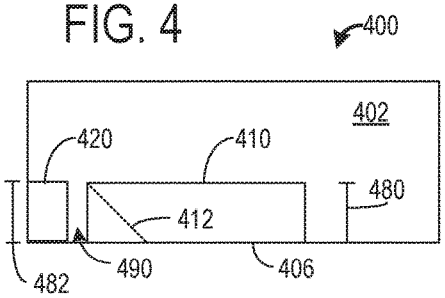
FIG. 4 shows a first embodiment of the noise attenuation device.

FIG. 4 shows a cross-sectional view 400 of a first embodiment of a noise attenuation device 410 spaced away from a throttle body 420 in a downstream direction in a bottom portion of an intake passage 402. A space 490 between the components may be 1-5 mm. As shown, heights 480, 482 of the noise attenuation device and the portion of the throttle body 420 in the intake passage 402 are substantially equal, respectively. Dashed line 412 indicates another embodiment for the noise attenuation device 410, wherein noise attenuating features (vanes) of the noise attenuation device 410 may be tapered via an angled cut along the dashed line 412 (herein referred to as angled cut 412). The angled cut 412 may begin at a top, upstream corner of the device 410 and traverse obliquely downward toward a base 406 of the device. The angled cut 412 may be between a range of 15–75°. In one example, the angled cut is exactly 45°. In this way, vanes may be rectangular, extending along a greater portion of the intake passage 402 than vanes including the angled cut. The device 410 including the angled cut may comprise triangular vanes.

Figure 5:
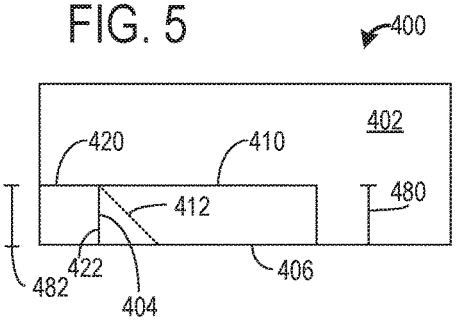
FIG. 5 shows a second embodiment of the noise attenuation device.

FIG. 5 shows a cross-sectional view 500 of a second embodiment of a noise attenuation device 410. Thus, components previously presented may be similarly numbered in subsequent figures. The second embodiment in the cross-sectional view 500 is identical to the first embodiment in the cross-sectional view 400 of FIG. 4, except the second embodiment shows the noise attenuation device being pressed against the throttle body (the space 490 is not present in the second embodiment). In this way, an upstream face 404 of the noise attenuation device is in face-sharing contact with a downstream face 422 of the portion of the throttle body 420 in the intake passage 402 for an entire length of the heights 480 and 482. The angled cut 412 may begin at an upper upstream corner of the device 410 and end at a corresponding portion of the base 406 based on an angle of the angled cut 412.

Figure 6:
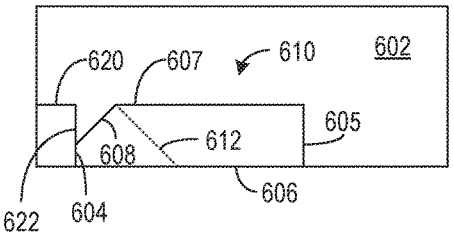
FIG. 6 shows a third embodiment of the noise attenuation device.

FIG. 6 shows a cross-sectional view 600 of a third embodiment of a noise attenuation device 610. Device 610 is disposed downstream of a portion of a throttle body 620 protruding into an intake passage 602. Device 610 is in face-sharing contact (pressed against) a downstream face 622 of the throttle body 620 for an entire length of the upstream side 604 before the upstream side begins to angle away from (angled side 608) the downstream face 622 of the throttle body 620. The device 610 has five sides, with upstream 604 and downstream 605 sides normal to a general direction of intake flow, base 606 and top side 607 parallel to the direction of intake flow, and the angled side 608 oblique to intake flow. The device may include an optional angular cut 612 (indicated by a dashed line), which may taper the device 610 from a top of the upstream side 604 and bottom of the angled side 608 to a base 606. The angled cut 612 may be between 15-75°. The device 610 including the angular cut 612 is tapered and includes four sides, namely the upstream side 604, the angled side 608, a tapered side created by the angular cut 612, and base 606.

Figure 7:
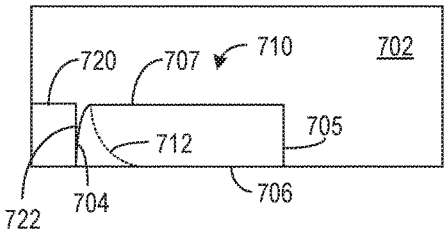
FIG. 7 shows a fourth embodiment of the noise attenuation device.

FIG. 7 shows a cross-sectional view 700 of a fourth embodiment of a noise attenuation device 710. Device 710 is disposed downstream of and pressed against a portion of a throttle body 720 protruding into an intake passage 702. A portion of an upstream side 704 of the device 710 is in face-sharing contact with a downstream side 722 of the throttle body 720 before the upstream side begins to curve away from the throttle body 720. As shown, upstream side 704 is convex, but it may be concave in other examples. In this way, the device 710 includes three linear sides (downstream side 705, base 706, and top side 707) with one curved side (upstream side 704). An optional curved cut is shown by dashed line 712, where the cut may begin at an interface between the upstream side 604 and the top side 707) and end at the base 706. As shown, the dashed line 712 is concave, but may be linear or convex in other examples.

Thus, the embodiments of FIGS. 4-7 depict a noise attenuation device with vanes molded onto a base and where the base is coupled to at least a portion of an intake pipe with a throttle body located within the intake pipe. The vanes may be upstream or downstream of the throttle body along a bottom or top portion of an intake passage.

In this way, noise emanating from an intake passage may be reduced or prevented without decreasing a power output of an engine. A noise attenuation device may be placed downstream of a change in radius between an intake passage and a throttle body, where the intake passage has a first radius greater than a second radius of the throttle body. The noise attenuation device has a height substantially equal to or less than the change in radius and is at a location where a valve of the throttle body may direct air based on a rotation of the valve corresponding to a change in engine load. The technical effect of placing the device downstream of the discontinuity is to diffuse and/or redirect intake flow such that an impact of intake air hitting an interior surface of the intake passage is reduced. Thus, noise created by intake air flow may be decreased.

An intake system comprising a throttle body in an intake passage with a bore having a first radius smaller than a second radius of the intake passage and a noise attenuation device with a plurality of vanes located in the intake passage directly downstream of the throttle body where a height of the vanes is substantially equal to a difference between the radiuses. A first example of the intake system optionally including where the bore and the intake passage are concentric. A second example of the intake system optionally including the first example, and further including the plurality of vanes are spaced about an inner circumference of the intake passage substantially equidistant from one another. A third example of the intake system optionally including one or more of the first and second examples, and further including where the noise attenuation device is physically coupled to an interior surface in a bottom portion of the intake passage. A fourth example of the intake system optionally including one or more of the first through third examples, and further including where the noise attenuation device has a rectangular cross-section. A fifth example of the intake system optionally including one or more of the first through fourth examples, and further including where the noise attenuation device is tapered and has a triangular cross-section. A sixth example of the intake system optionally including one or more of the first through fifth examples, and further including where the plurality of vanes extend inwardly from a base of the noise attenuation device into the intake passage in an axial direction, and where the height of the vanes is greater along an outer portion of the noise attenuation device. A seventh example of the intake system optionally including one or more of the first through sixth examples, and further including where the plurality of vanes extend inwardly from a base of the noise attenuation device into the intake passage in a radial direction, and where the height of each of the vanes is equal and fixed. An eighth example of the intake system optionally including one or more of the first through seventh examples, and further including where the noise attenuation device is spaced away from a portion of the throttle body in the intake passage. A ninth examples of the intake system optionally including one or more of the first through eighth examples, and further including where the noise attenuation device is pressed against a portion of the throttle body in the intake passage.

A method of operating an intake system in a passenger vehicle traveling on the road, the method comprising directing an intake flow to an engine of the vehicle via an intake passage, where the passage includes a throttle body with a bore and where a radius of the bore is smaller than a radius of the intake passage and operating a throttle valve of the throttle body to adjust a volume of intake flow in the intake passage, where the vanes protrude inwardly into the intake passage for a predetermined distance equal to a difference in radiuses between the bore and the intake passage. A first example of the method further including where the vanes protrude only partially into the intake passage and do not span across the intake passage. A second example of the method optionally including the first example and further including where the vanes are spaced along an inner circumference of the intake passage equidistant from each other such that the vanes are configured to diffuse intake flow. A third example of the method optionally including the first and/or second examples and further including where the vanes are pressed against or spaced away from the throttle body in upstream and downstream portions of the intake passage.

A system comprising a throttle body having a first bore wall with a valve mounted within the first bore, the valve being movable to selectively restrict intake flow, an intake passage having an intake pipe defining a second bore wall and where the second bore has a greater diameter than the first bore, and a noise attenuation device located downstream of the valve and the first bore in the first bore of the intake passage with a plurality of vanes extend inwardly into the second bore for a predetermined distance equal to a difference between the radiuses of the first and second bores. A first example of the system further including where the vanes are molded onto a base and where the base is coupled to at least a portion of the intake pipe. A second example of the system optionally including the first example and further including where the vanes and the base comprise of a similar material. A third example of the system optionally including the first and/or second examples and further including where the vanes are configured to diffuse and redirect intake flow directed toward a lower portion of the intake passage. A fourth example of the system optionally including one or more of the first through third examples, and further including where the vanes are located around a portion of an inner circumference of the second bore. A fifth example of the system optionally including one or more of the first through fourth examples, and further including where the intake passage continues downstream of the throttle body such that an upstream intake passage and a downstream intake passage sandwich the first bore. A sixth example of the system optionally including one or more of the first through fifth examples, and further including where the noise attenuation device comprises only a single set of vanes pressed against or spaced away from the first bore wall.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An intake system comprising:

a throttle body in an intake passage, said throttle body defining a first bore wall having a first diameter, and said intake passage defining a second bore wall having a second diameter, such that the first diameter of the throttle body is smaller than the second diameter of the intake passage; and a noise attenuation device physically coupled to only a bottom portion of the intake passage, said noise attenuation device comprising:

a plurality of vanes positioned directly downstream of the throttle body, wherein said plurality of vanes are tapered via an angled cut extending from a maximum height of the plurality of vanes to a base of the noise attenuation device, such that each of the plurality of vanes has a triangular cross-section in a direction of intake airflow, and wherein the maximum height of the plurality of vanes is substantially equal to a difference between the first diameter of the throttle body and the second diameter of the intake passage.

2. The intake system of claim 1, wherein the first bore wall of the throttle body and the second bore wall of the intake passage are concentric.

3. The intake system of claim 1, wherein the plurality of vanes are spaced about an inner circumference of the intake passage substantially equidistant from one another.

4. The intake system of claim 1, wherein the plurality of vanes extend from the base of the noise attenuation device into the intake passage in an axial direction, and wherein a height of the plurality of vanes is greatest along an outer portion of the noise attenuation device.

5. The intake system of claim 1, wherein the plurality of vanes extend radially inward from the base of the noise attenuation device into the intake passage, and wherein a height of each vane of the plurality of vanes is equal and fixed.

6. The intake system of claim 1, wherein the noise attenuation device is spaced away from a portion of the throttle body in the intake passage.

7. The intake system of claim 1, wherein the noise attenuation device is pressed against a portion of the throttle body in the intake passage.

8. A method of operating an intake system in a passenger vehicle, the method comprising:

directing an intake airflow to an engine of the vehicle via a throttle body in an intake passage, said throttle body defining a first bore wall having a first diameter, and said intake passage defining a second bore wall having a second diameter, such that the first diameter of the throttle body is smaller than the second diameter of the intake passage; and operating a throttle valve of the throttle body to adjust a volume of the intake airflow in the intake passage, wherein vanes of a noise attenuation device are pressed against the throttle body and protrude radially inward into the intake passage, the vanes tapered via an angled cut extending from a maximum height of the vanes to a base of the noise attenuation device, such that each of the vanes has a triangular cross-section in a direction parallel to the intake airflow, and wherein the maximum height of the vanes is equal to a difference between the first diameter of the throttle body and the second diameter of the intake passage.

9. The method of claim 8, wherein the vanes protrude only partially into the intake passage and do not span across the intake passage.

10. The method of claim 8, wherein the vanes are spaced along an inner circumference of the intake passage equidistant from each other such that the vanes are configured to diffuse the intake airflow.

11. The method of claim 8, wherein the vanes are pressed against or spaced away from the throttle body on both an upstream side of the throttle body and a downstream side of the throttle body.

12. A system comprising:

a throttle body defining a first bore wall having a first diameter, the throttle body including a throttle valve mounted within the first bore wall, the throttle valve being movable to selectively restrict intake airflow;

an intake passage defining a second bore wall having a second diameter, such that the second diameter of the intake passage is greater than the first diameter of the throttle body; and a noise attenuation device located downstream of the throttle valve in the intake passage, the noise attenuation device comprising:

a plurality of vanes extending radially inward from the second bore wall of the intake passage toward the first bore wall of the throttle body, wherein said plurality of vanes are tapered via an angled cut extending from a maximum height of the plurality of vanes to a base of the noise attenuation device, such that each of the plurality of vanes has a triangular cross-section in a direction of the intake airflow, and wherein the maximum height of the plurality of vanes is equal to a difference between the first diameter of the throttle body and the second diameter of the intake passage.

13. The system of claim 12, wherein the plurality of vanes are molded onto the base of the noise attenuation device and wherein the base of the noise attenuation device is coupled to at least a portion of the intake passage with no intervening components arranged between the throttle body and the noise attenuation device.

14. The system of claim 12, wherein the plurality of vanes are configured to diffuse and redirect the intake airflow along a lower portion of the intake passage.

15. The system of claim 12, wherein the plurality of vanes are located around a portion of an inner circumference of the second bore wall.

16. The system of claim 12, wherein the intake passage extends from both an upstream side and a downstream side of the throttle body so as to sandwich the first bore wall of the throttle body.

17. The system of claim 16, wherein the plurality of vanes are pressed against or spaced away from the throttle body on only one of the upstream side or the downstream side of the throttle body.

* * * * *